US006715725B2

(12) United States Patent
Chipka

(10) Patent No.: US 6,715,725 B2
(45) Date of Patent: Apr. 6, 2004

(54) RAILING SPINDLE BRACKET AND MOUNTING METHOD

(76) Inventor: Robert S. Chipka, 4366 Woodlake Trail, Wooster, OH (US) 44691

( * ) Notice: Subject to any disclaimer, the term of this patent is extended or adjusted under 35 U.S.C. 154(b) by 0 days.

(21) Appl. No.: 10/092,790

(22) Filed: Mar. 7, 2002

(65) Prior Publication Data

US 2003/0168560 A1 Sep. 11, 2003

(51) Int. Cl.[7] ..... A47B 96/06
(52) U.S. Cl. ..... 248/218.4
(58) Field of Search ..... 248/218.4, 219.4, 248/220.21, 223.41, 224.51, 224.61, 224.7, 314; 108/42, 108, 147.15, 147.17, 149, 152

(56) References Cited

U.S. PATENT DOCUMENTS

| | | | | | |
|---|---|---|---|---|---|
| 1,189,098 | A | | 6/1916 | Hall | |
| 2,481,604 | A | | 9/1949 | Lorenzen | |
| 2,774,562 | A | | 12/1956 | Henry | |
| 2,912,205 | A | | 11/1959 | Toune | |
| 3,370,820 | A | | 2/1968 | Liss | |
| 3,416,282 | A | * | 12/1968 | Daugherty | 52/716.8 |
| 3,468,428 | A | * | 9/1969 | Reibold | 211/144 |
| 3,561,563 | A | | 2/1971 | Harsh | |
| 3,580,191 | A | | 5/1971 | McDonnell | |
| 3,620,174 | A | | 11/1971 | Dentino | |
| 3,817,394 | A | * | 6/1974 | Saiki | 211/110 |
| 3,881,677 | A | * | 5/1975 | Ihlenfeld | 248/311.2 |
| D236,051 | S | | 7/1975 | Opincar, Sr. | |
| 3,945,596 | A | | 3/1976 | Marraccini | |
| 3,983,823 | A | | 10/1976 | McDonnell | |
| 4,242,848 | A | * | 1/1981 | Schoultz | 52/717.06 |
| 4,415,137 | A | | 11/1983 | Garves | |
| 4,516,365 | A | * | 5/1985 | Chapman | 52/170 |
| 4,570,383 | A | * | 2/1986 | Adell | 49/462 |
| 4,613,135 | A | * | 9/1986 | Rush | 473/488 |
| 4,768,320 | A | * | 9/1988 | Weller | 52/211 |
| 4,878,642 | A | | 11/1989 | Kirby, Jr. | |
| 4,953,716 | A | | 9/1990 | Rapoport | |
| 5,220,744 | A | * | 6/1993 | Kendall | 47/39 |
| 5,369,925 | A | * | 12/1994 | Vargo | 52/244 |
| 5,395,081 | A | | 3/1995 | Vollink | |
| 5,443,234 | A | | 8/1995 | Woods | |
| 5,622,356 | A | * | 4/1997 | Duggan | 256/1 |
| 5,815,998 | A | * | 10/1998 | Wamsher | 52/211 |
| 5,826,398 | A | * | 10/1998 | Carnicle | 52/698 |
| 5,845,743 | A | | 12/1998 | Dechant | |
| 5,941,486 | A | * | 8/1999 | Riblet | 248/219.4 |
| 2002/0020791 | A1 | * | 2/2002 | Kempf et al. | 248/218.4 |

* cited by examiner

*Primary Examiner*—Leslie A. Braun
*Assistant Examiner*—Kofi Schulterbrandt
(74) *Attorney, Agent, or Firm*—Richard B. O'Planick

(57) ABSTRACT

A bracket for attachment to a railing spindle includes an elongate socket body composed of resilient, elastomeric material and having a forward sidewall, lateral opposed sidewalls, and rearward sidewall portions defining an elongate chamber therebetween. An elongate access channel is defined between the rearward sidewall portions having a width nominally less than the width of a railing spindle. Outward biasing force is exerted upon the lateral sidewalls of the socket body and acts to widen the access channel and allow passage of the railing spindle in the socket body chamber. Release of the biasing force allows the lateral sidewalls and the rearward sidewalls to resume an original relationship and narrow the access channel. A method of effecting a mounting of the bracket to a railing spindle includes the steps of: positioning the socket body of the bracket at an acute angle adjacent the railing spindle with a lower end of the socket body close to the railing spindle; registering the railing spindle into the open lower portion of the socket body chamber; rotating an upper end of the socket body about the lower end toward the railing spindle; applying a directional biasing force to the lateral sidewalls that moves the rearward sidewall portions outward and widens the access channel therebetween; passing the railing spindle through the widened access channel and into the socket body chamber; and removing the applied biasing force, releasing the lateral and rearward sidewall portions to resume an original position and narrow the access channel.

12 Claims, 5 Drawing Sheets

RAILING SPINDLE BRACKET AND MOUNTING METHOD

TECHNICAL FIELD

The present invention relates generally to a bracket that attaches to a vertical post and, more specifically, to a railing spindle bracket and mounting method for suspending sundry articles from a railing spindle.

BACKGROUND ART

Railings are commonly functional features within home and office environments. For example, many homes include an outdoor deck area that includes a wooden railing surrounding the deck surface. The railing is configured to typically comprise a horizontal upper hand rail and a plurality of vertically oriented, spaced-apart wooden spindles extending between the handrail and the deck frame. The spindles provide structural support and isolate the deck area from surrounding environs. An informal standard has evolved within the industry whereby the spindles in outdoor decking applications have a two by two inch external dimension.

Similarly, railings may be present at multiple locations within the interior of a home or commercial establishment, typically as either part of a stairway banister or as a hallway railing. Common stairway and hallway railings likewise utilize spindles having the same standard two by two inch external dimension. An enlarged shoulder block is frequently employed at the base of each spindle and anchors a lower base end of each spindle to the stairway risers or sub-flooring.

Stairway, hallway, and deck railings perform a useful and necessary safety function in affording the user a handgrip, but heretofore no satisfactory means has existed for customizing or decorating such railings to reflect the tastes and preferences of the owner or occupant. Consequently, stairway, hallway, and deck railings offer a sterile and homogenized appearance that does little to add to the aesthetic appearance of a home or commercial establishment. A need, accordingly, exists for means by which stairway, hallway, and deck railings may be decorated in a customized manner. Moreover, a need exists for ways of utilizing the presence of stairway, hallway and deck railings beyond the primary function that each provides as a safety handgrip or enclosure. For example, it would be desirable to add decorative elements such as potted plants, photographs, statuary, etc. to railing areas.

In order to augment the utility and aesthetic appearance of stairway, hallway, and deck railings, shelf attachments have been proposed that connect to the vertical spindles of the railings. The shelf unit may optionally provide a surface for supporting decorative elements such as plants, pictures, etc., or serve to display or support utilitarian objects such as cup and dishware. Available shelf units may attach at alternative vertical positions along respective spindles to afford the user decorating and functional options.

U.S. Pat. Nos. 5,443,234 and 5,395,081 disclose state-of-the-art shelf attachment devices that mount to a vertical post such as a railway spindle at different elevations along the post. The '234 patent teaches a shelf member disposed upon a pivotal support arm. Post-engaging brackets are adjusted by a threaded bolt to clamp against the vertical post and hold the unit in position. While functioning well, however, the '234 shelf does not adequately address all needs of the end user. The shelf assembly is multi-piece, and requires hardware to achieve a tight clamp. Such structure adds to the overall cost of the shelf and makes the shelf cumbersome to attach and detach from a post. Moreover, the unit is aesthetically functional in appearance and detracts from the appearance of the articles supported thereby.

Additionally, the bracket of the '234 patent is not economical to transport and cannot be conveniently mounted and removed from a post without a tool. An additional deficiency is that the clamp utilized to affix the bracket to a post can leave an undesirable mark on the post once removed. A further shortcoming is that the bracket shown in the '234 reference provides a user with shelf but does not address or remedy possible needs of the end user for other article supporting structures.

The bracket taught by U.S. Pat. No. 5,395,081 remedies one deficiency in the '234 patent by providing a unitarily constructed bracket rather than a multi-piece configuration. The '081 bracket is constructed of stamped metal and comprises a C-shaped opening that receives a support post. Teeth are provided that project into one side of the opening and engage the post. A shelf extends from an opposite side of the bracket and serves as a support for a potted plant or the like.

While functioning well, the '081 bracket fails to satisfy all of the requirements of an end user. For example, the bracket is formed of stamped metal and affixes to a post by means of sharp teeth, which can leave unsightly marks within the post upon removal. Additionally, the bracket is formed by a relatively expensive stamping operation and does not readily provide a user with color options. Paint applied to surfaces of the bracket will tend to wear away in areas in which the bracket makes contact with the support post. Moreover, the '081 bracket shelf has a downward bias when the bracket is suspended from a post and provides a less attractive appearance thereby. Finally, the bracket provides a user with a plant shelf but does not address or remedy possible needs of the end user for other article supporting structures and applications.

DISCLOSURE OF THE INVENTION

The present invention obviates the aforementioned deficiencies in state-of-the art vertical post-mounted brackets by providing a unitarily formed bracket of resilient plastic material. The bracket may be made in various colors by conventional plastic molding manufacturing methods and is economically and readily manufactured and transported. The bracket affixes to the base end of a vertical spindle in railways without the need for assembly hardware or tools. The user may optionally utilize a screw or other attachment device to move the bracket to alternative vertical locations on the spindle if so desired. The bracket is formed having an enclosed socket body configured to provide forward, lateral, and partial rearward sidewalls defining an internal socket body chamber. The rearward side of the socket body has opposed rearward sidewall portions partially enclosing an upper portion of the chamber and defining an elongate access channel therebetween communicating with the upper portion of the chamber. In a quiescent state, the access channel is sized smaller in width than a width dimension of a rail spindle. A lower portion of the socket body channel below the rearward sidewall portions is rearward open.

The lateral sidewalls of the socket body flex laterally to widen the access channel and allow admittance of a rail spindle into the socket body chamber. Upon release of the bracket, the lateral sidewalls of the bracket body flexibly return to an original configuration, narrowing the access channel and entrapping the rail spindle within the socket body chamber. The bracket may readily be removed by reversing the procedure and does not leave any unsightly mark upon the spindle once removed.

The present invention further envisions use of the subject bracket in multiple alternative configurations providing the end user with functional and aesthetic options. For example the bracket may be manufacture to provide a shelf surface extending outward from a forward side. Alternatively, other configurations of the bracket may be manufactured to provide a cup holder, a flag pole socket, a planter, or specialized sockets and compartments at a forward side, providing the user with decorating and utilitarian options in customizing railings.

A further aspect of the invention is to provide a method of mounting the bracket to a railing spindle, comprising the steps of positioning the socket body at an acute angle adjacent the railing spindle with a lower end of the socket body closest to the railing spindle; registering the rail spindle into the open lower portion of the socket body chamber; rotating an upper end of the socket body about its lower end and toward the rail spindle; applying a directional force to the rearward sidewall portions to flex the rearward sidewall portions outward and widen the access channel; passing the rail spindle through the widened access channel, and removing the applied force to allow the rearward sidewall portions to resume a normal configuration, whereby narrowing the access channel to a closed position.

PREFERRED EMBODIMENT FOR CARRYING OUT THE INVENTION

Figure 1:
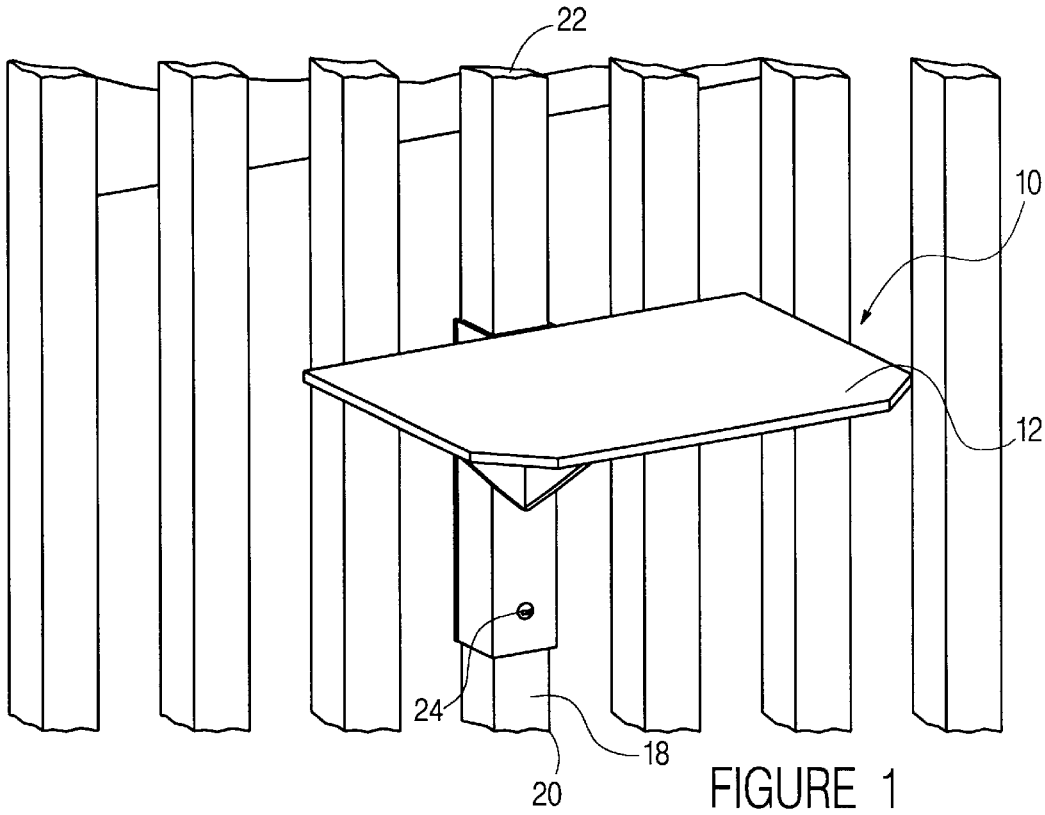
FIG. 1 is a left front perspective view of a bracket and shelf device of the present invention mounted to a deck railing spindle.
Figure 2:
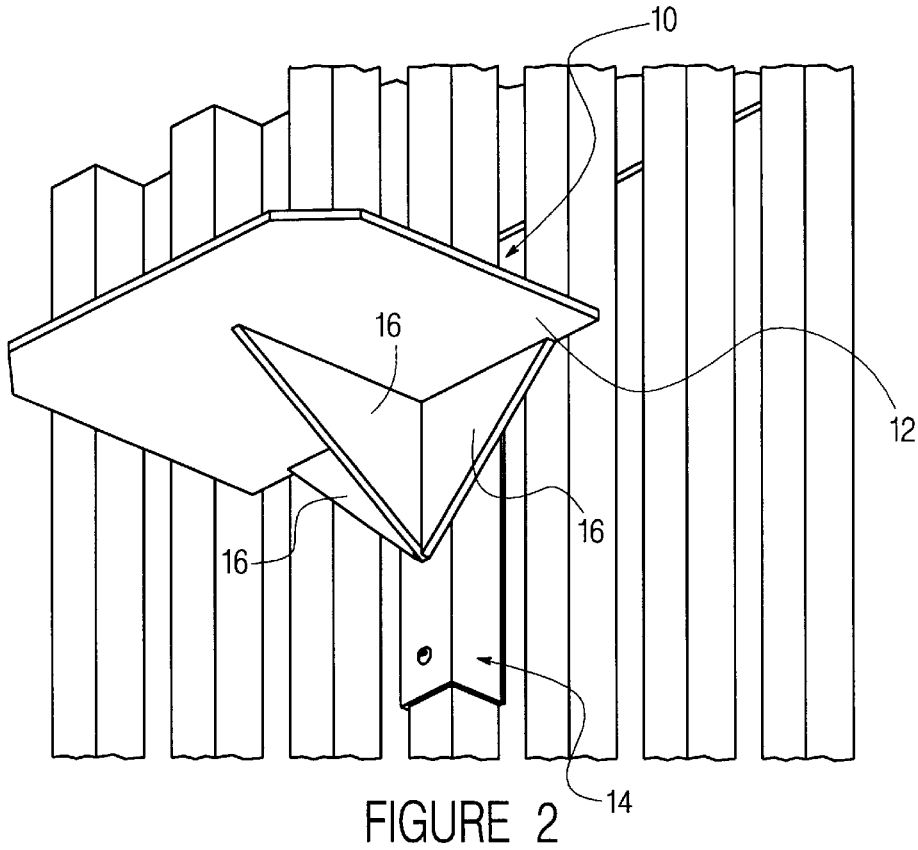
FIG. 2 is a bottom right perspective view thereof.

Referring initially to FIGS. 1 and 2, the subject invention is shown in a first embodiment to comprise a shelf and bracket device 10 integrally molded of conventional plastic material, such as polyethylene, by conventional manufacturing methods such as injection molding. The bracket and shelf configuration 10 represents one of multiple alternative embodiments that may be utilized incorporating the novel aspects of the present invention as will be explained below. The unitary body 10 may be readily manufactured and transported, reducing shipping and assembly costs endemic to state-of-the-art alternatives. Moreover, as explained below, the device 10 may be suitably mounted without a tool or assembly hardware in certain applications, and with a single screw in other applications.

The device 10 includes an integrally formed shelf platform 12 and bracket 14. The platform 12 is substantially flat in the shown embodiment but may be modified to other configurations if so desired for a particular application. The bracket 14 connects to the platform 12 by means of three reinforcement flanges 16 as shown. Flanges 16 structurally reinforce the shelf 12. The device 10 mounts to a railing spindle 18 of a type commonly found in outdoor deck railings or indoor stairway and hallway railings. The spindle 18 represents one of multiple vertical support posts connecting an upper hand rail (not shown) to bottom framing of the deck. Spindles of the type shown may be of various dimensions but a standard has evolved in the construction industry whereby spindles for deck, hallway, and stairway railings are generally two by two inches in dimension and are formed of conventional soft or hardwood material.

As shown if FIGS. 1 and 2, the device 10 may be mounted at different elevations along the vertical spindle 18 between a lower spindle terminal end 20 and an upper spindle terminal end 22 if so desired by the end user. The use of fastener hardware 24 such as a wood screw is employed to affix the device 10 at alternative elevations along the spindle 18. Other means of fastening the device 10 may be alternatively used without departing from the subject invention.

With reference to FIGS. 6, 7, 8, and 9, the device 10 is shown in greater detail. The bracket 14 comprises a forward sidewall 26, opposed and spaced apart lateral sidewalls 28, 30, and coplanar and adjacent rearward sidewall portions 32, 34. Collectively, walls 26, 28, 30, 32, and 34 define an elongate quadrilateral internal socket compartment 36. An upper end 38 of the sidewalls 26–34 terminates at the shelf platform 12. The rearward sidewall portions 32, 34 partially enclose an upper end of the compartment 36 and extend downward from their respective upper ends 38 to respective tapered lower edges 42. Sidewall portions 32, 34 further include inwardly directed and opposed edges 44, 46 respectively. Extending downwardly along the edges 44, 46 are outwardly projecting edge flanges 48, 50 that, as will be explained below, offer a user the means for gripping the sidewall portions 32, 34. While shown as elongate flanges 48, 50, other structural means may be deployed if so desire to afford a user the means for digitally grasping the rearward sidewall portions 32, 34. Without exhausting such alternative means, dents, protrusions, or surface texture may be used to allow the user to more easily grasp the edges of the rearward sidewall portions 32, 34. The means so employed may also be relocated from the edges 44, 46 to alternative locations on the rearward sidewall portions 32, 34, if so desired, without departing from the subject invention.

The opposed edges 44, 46, of the rearward sidewall portions 32, 34 define an elongate access channel 52 communicating with the internal compartment 36. The channel is nominally sized in width dimension to be smaller than the standardized two inches width of a railway spindle. The channel 52 communicates with an upper compartment portion 54. A lower portion 56 of the compartment 36 below the lower sloped edges 42 of the rearward sidewall portions 32, 34 is rearwardly open and extends between the lateral sidewalls 28, 30. The three-sided lower portion of the bracket 14 assists in the mounting of a bracket to a spindle as will be explained below. A screw through hole 58 extends through a lower portion of the forward sidewall 26 utilized for positioning bracket 14 at various alternative locations along a respective spindle.

It will be appreciated that the reinforcement flanges 16 connect the forward sidewall 26 to the platform surface 12 and reinforce the surface 12. The surface 12 is represented as a horizontal shelf. Alternative configurations and shelf shapes may be employed, however, if so desired. An edge flange may also be incorporated into the platform surface 12 to contain articles displayed upon the surface.

Figure 3:
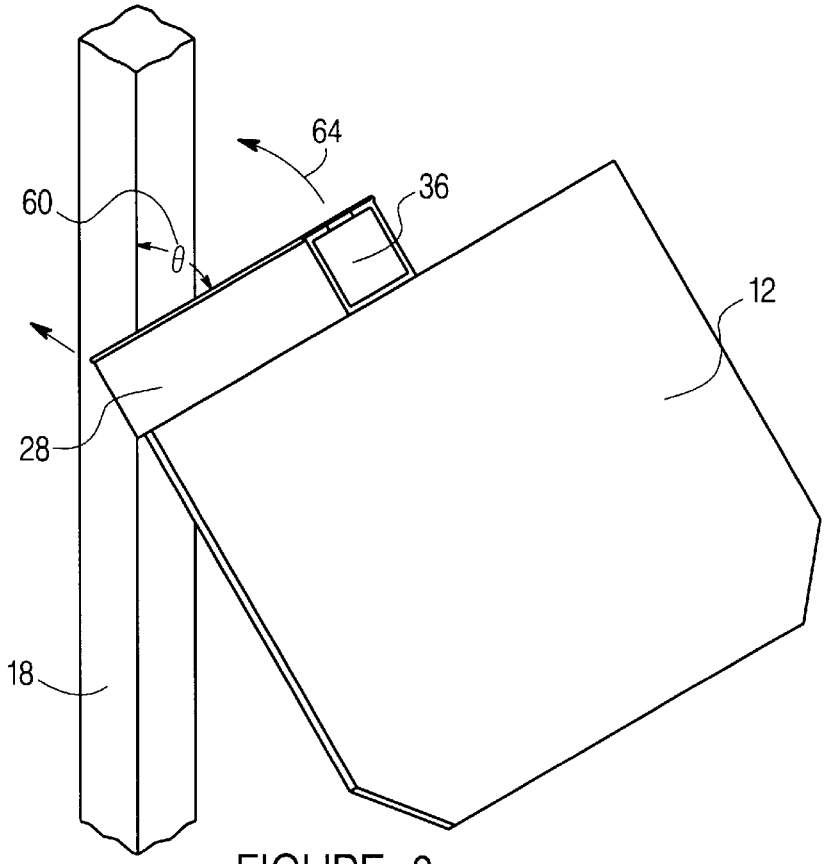
FIG. 3 is a left top perspective view of a bracket and self-device configured pursuant to the present invention shown in a preliminary mounting orientation relative to a railing spindle.
Figure 4:
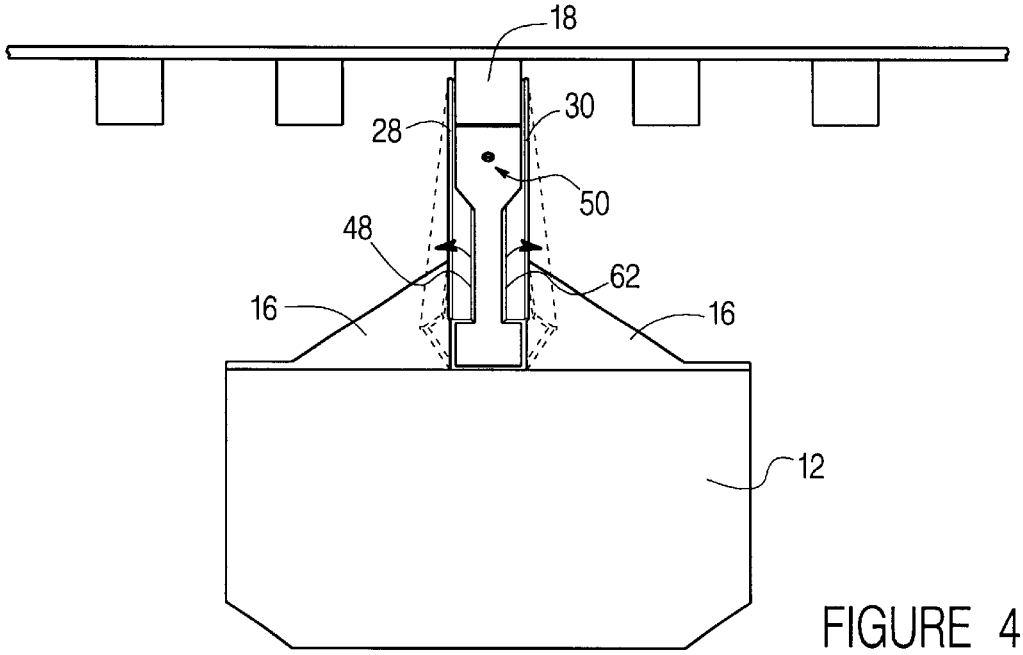
FIG. 4 is a top plan view thereof.

With reference to FIGS. 3 and 4, the mounting of shelf and bracket device 10 to a railway spindle will be explained. A lower end of bracket is positioned against the railway spindle with the bracket angled away from the spindle 18 at an acute angle θ of approximately forty-five degrees. The angle θ may be varied more or less if desired. The open lower portion 56 of bracket compartment 36 closely receives the spindle 18 therein as lateral sidewalls 28, 30 are spaced apart to allow lateral entry of the spindle therebetween. So positioned, the lower end of the bracket is registered against the spindle and angles upwardly and away therefrom at the angle θ.

The user digitally grasps the edge flanges 48, 50 of the rearward sidewall portions 32, 34 and applies an outwardly directed force there against, causing the sidewall portions 32, 24 to spread outward. The lateral sidewalls 28, 30 resiliently flex outward responsive to the force in direction 62 along forward edges adjoining forward sidewall 26. The outward flexure of the lateral sidewalls 28, 30 and rearward sidewall portions 32, 34 is facilitated by the resiliency of the plastics material from which each is formed. Outward flexure of the sidewalls causes the access channel 52 to widen to a width nominally greater than the width of spindle 18. The bracket is rotated about a lower end toward the spindle 18. When the rearward sidewall portions 32, 34 reach the spindle, the access channel 52 has been widened sufficiently to allow passage of the spindle through the access channel and into the compartment 36. Thereafter, the outward force against flanges 48, 50 is removed, whereupon the lateral bracket sidewalls resiliently spring inward, carrying rearward sidewall portions 32, 34 back into their original, quiescent, closed mutual orientation and narrowing the access channel 52 into a width smaller than the width of the spindle. The bracket is thus closed entrapping the spindle in close confinement within the compartment 36.

It will be observed that the mounting of bracket 14 to spindle 18 is effected manually without the need for mounting tools or hardware. Moreover, the bracket 14 does not engage the spindle 18 with sharp edges or teeth that can leave unsightly markings upon the spindle. Demounting the bracket 14 from the spindle 18 may likewise be effected without the need for tooling or hardware removal by reversing the steps set forth above. It will further be apparent that the lateral sidewalls 28, 30 can resiliently open and close the access channel 52 through repeated cycles because of the elastic spring properties of the plastics material from which the bracket is formed. The bracket 14 may be located at different vertical positions along the spindle 18. The screw 24 is inserted through the aperture 58 and into the spindle 18 when the bracket is positioned at the desired elevation.

Figure 5:
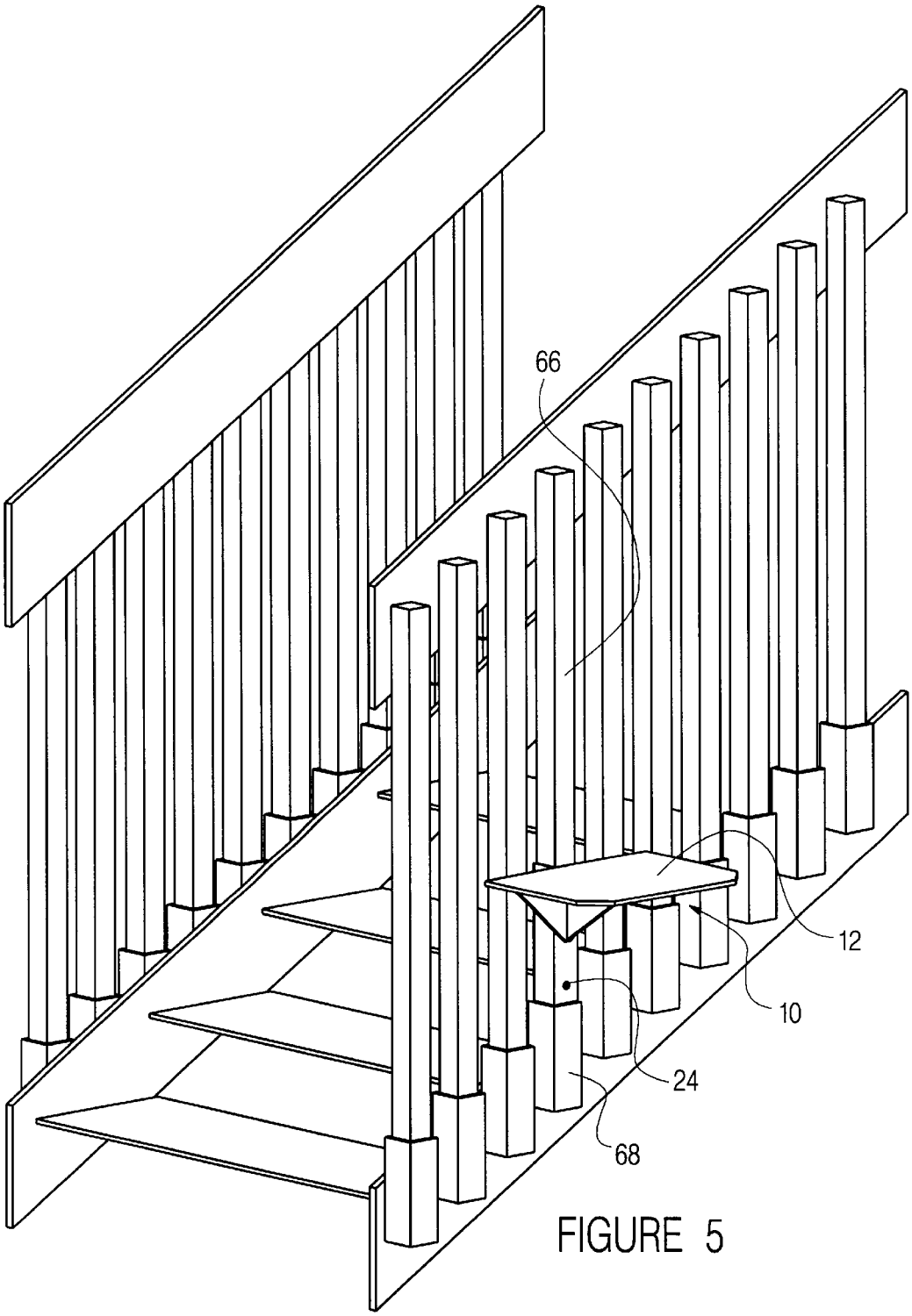
FIG. 5 is a left front perspective view of a bracket and shelf device configured pursuant to the present invention mounted to a stairway railing spindle.
Figure 7:
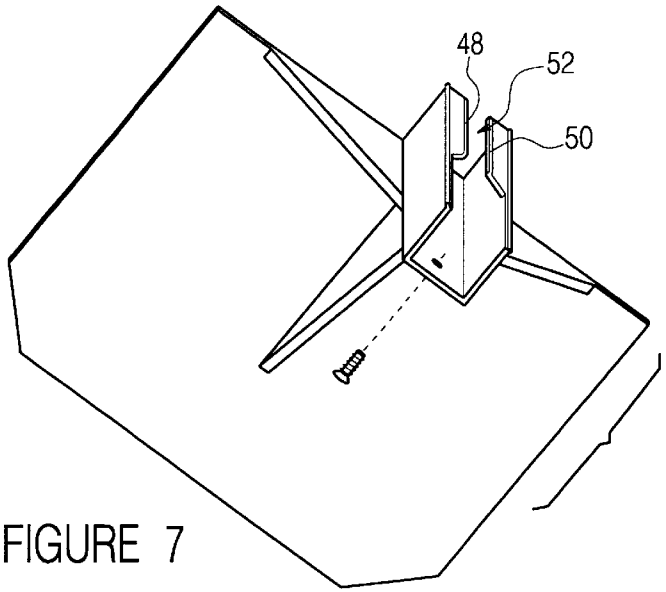
FIG. 7 is a bottom rear perspective view thereof.
Figure 9:
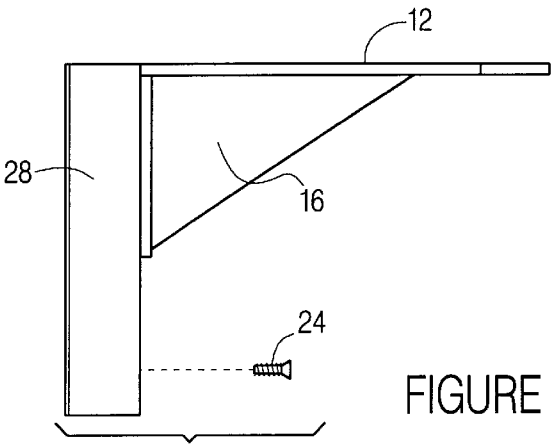
FIG. 9 is a left side elevational view thereof.
Figure 6:
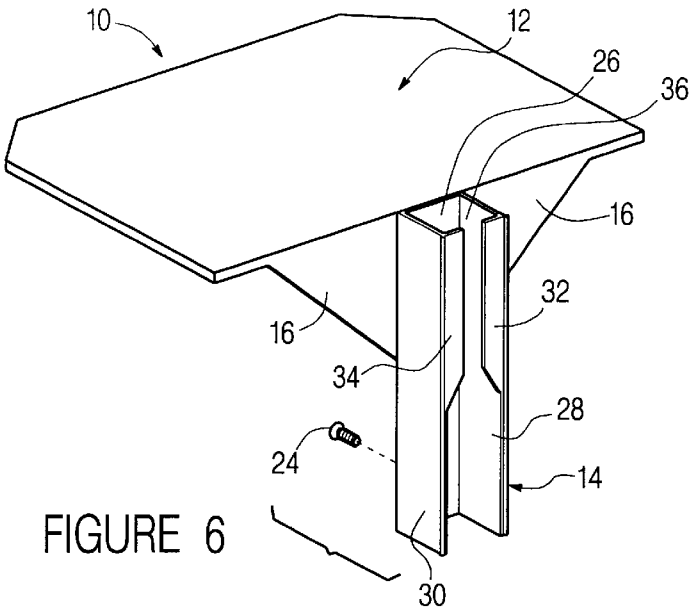
FIG. 6 is a rear left perspective view of a bracket and shelf device configured pursuant to the present invention.
Figure 8:
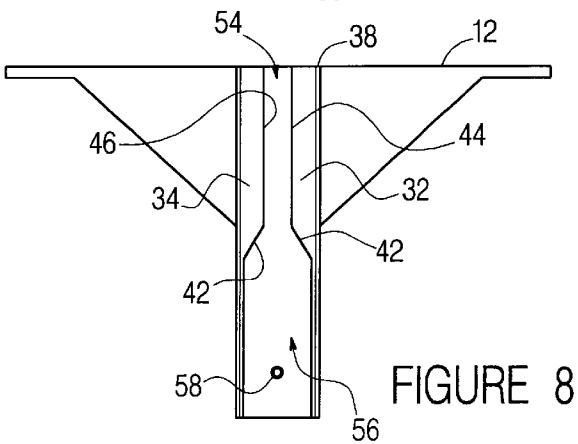
FIG. 8 is a rear elevational view thereof.

FIG. 5 illustrates the device 10 mounted to a stairway railing spindle 66. Typically railway spindles are two by two inches in sectional dimension and include a larger dimensioned support block 68 at a lower end that connects to the stairway riser. The block 68 provides a shoulder at an upper surface that may be utilized to support the bracket 14 thereupon, obviating the need for mounting screw 24. Thus, the subject bracket 14 may mount to a lowermost location on a stairway spindle of the type depicted without assembly hardware or tooling. In the mounted condition shown, the platform surface 12 is substantially horizontal and provides a surface for supporting decorative articles such as plants, planters, photographs, or collectibles. A single bracket and shelf device 10 may be employed or multiple units may be spaced up or along a railing if desired. The device 10 is unitarily constructed of conventional plastic material such as polyethylene by conventional manufacturing techniques such a injection molding. As such the unit 10 is readily manufactured and requires no assembly. In addition, the unit 10 may be conveniently transported; lowering its overall cost to end users, and can be mounted by the end user with minimal effort and inconvenience.

While the unit 10 in FIGS. 1–9 shows the subject bracket in tandem with a shelf platform 12, uses of the bracket 14 are not so limited. Other article support configurations for other applications may be envisioned that utilize the subject bracket 14. By way of example, without intending to delimit the scope of the invention thereby, the bracket 14 may be adapted to provide, in addition to shelf platform 12, a cup holder, a flag pole or lantern pole socket, a planter or basket holder, an ash tray, or utensil holders (not shown). The bracket 14 can be used to suspend such utilitarian article holding devices from railings for decorative or functional purposes. For example, a user may find it desirable to mount flags, planters, or cup holders along an outside deck railing and customize the deck area according to personal preference. The brackets 14 for such devices would mount in the manner described above and offer the user an economical and convenient means for improving the aesthetics or functional capability of railway spans both inside and outside a dwelling or structure.

Figure 11:
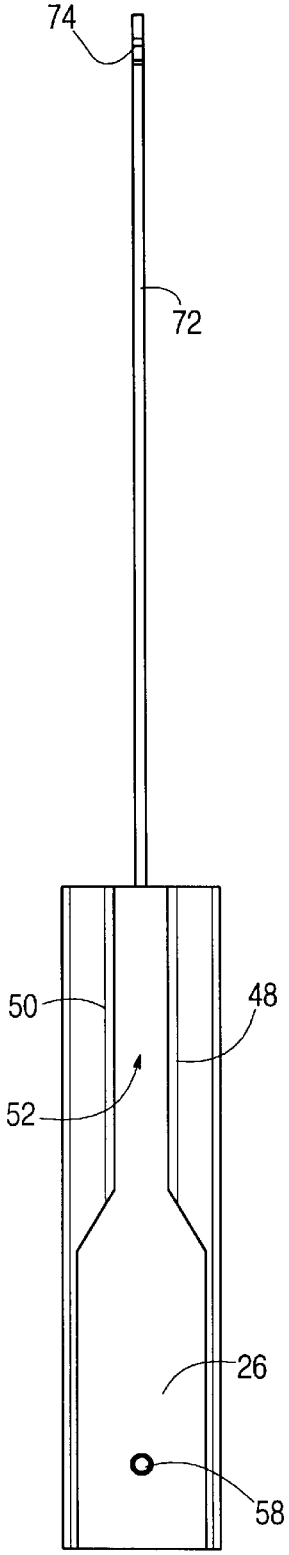
FIG. 11 is a left rear perspective view thereof.
Figure 10:
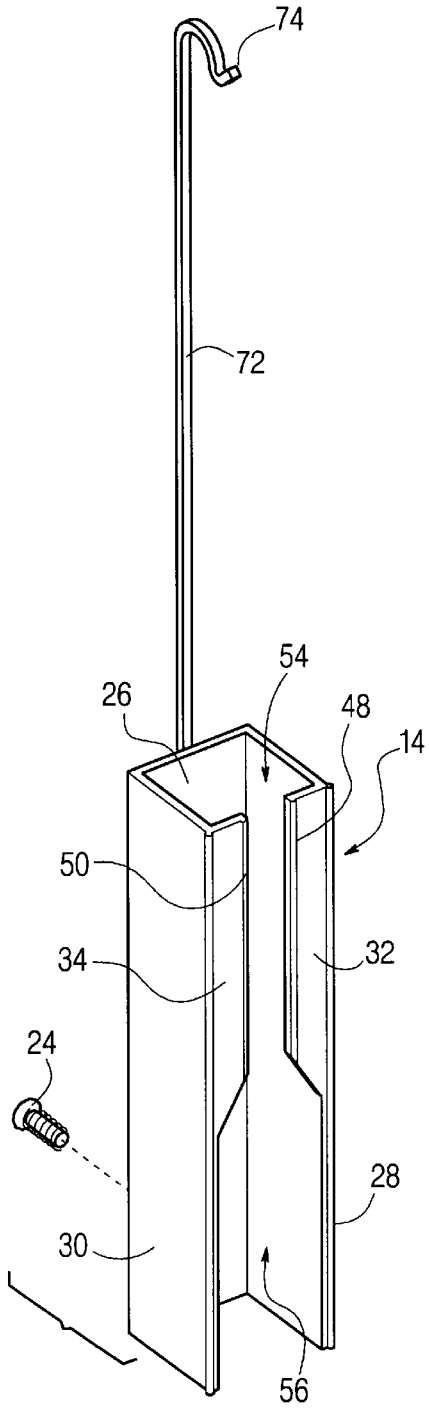
FIG. 10 is left rear perspective view of an alternative configuration of the subject invention showing a bracket and hook device.
Figure 12:
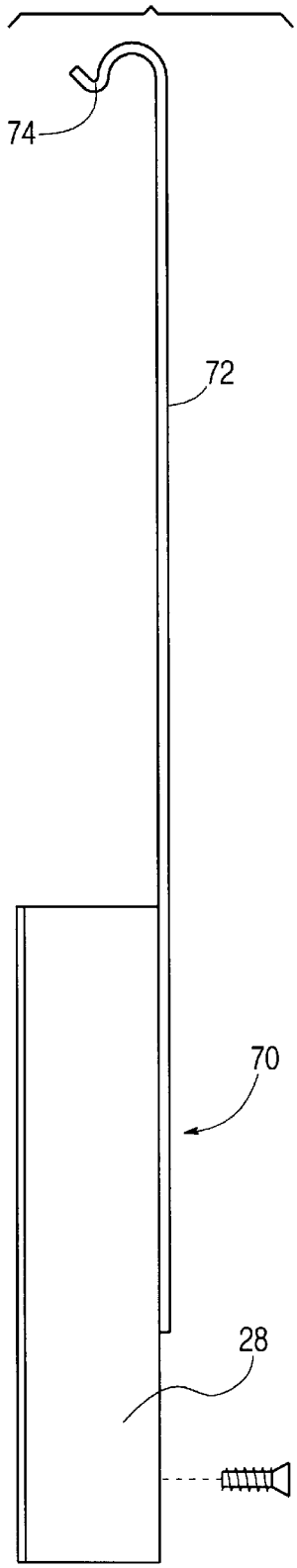
FIG. 12 is a left side elevational view thereof.

FIGS. 10, 11, and 12 show one of multiple alternative embodiments of the present invention. The bracket 14 is configured as described above and attaches to a vertical railway spindle in like manner. Instead of a horizontal shelf, however, a hook and bracket device 70 is provided comprising an elongate extension arm 72 having a hook 74 at a terminal end. The hook arm 72, hook 74, and bracket 14 are integrally formed of plastics material and may be attached to a vertical spindle of deck, stairway, and hallway railings at alternate vertical heights. The hook 74 may be used to suspend articles such as a hanging planter. Inherent in the configuration shown in FIGS. 10–12 are the advantages attendant the shelf embodiment; that is, the unit is integrally formed of plastics material and is economical to transport and display. The bracket relies upon the resilient spring properties of the lateral and rearward sidewalls to open and close the access channel and allow the spindle access to the axial chamber. The bracket does not efface the spindle and mounts and demounts easily with minimal hardware and tooling.

As with the shelf embodiment, attachment of the bracket 14 to a spindle includes the following steps: positioning the socket body of the bracket at an acute angle adjacent the railing spindle with a lower end of the socket body close to the railing spindle; registering the railing spindle into the open lower portion of the socket body chamber; rotating an upper end of the socket body about the lower end toward the railing spindle; applying a directional force to the lateral sidewalls that moves the rearward sidewall portions outward and widens the access channel therebetween; passing the railing spindle through the widened access channel and into the socket body chamber; and removing the applied force, releasing the lateral and rearward sidewall portions to resume an original position and narrow the access channel. Digitally engaging gripping means on the rearward sidewall portions also may be utilizing in effecting the aforementioned desired outward flexure of the lateral sidewalls.

While the above discloses a preferred and an alternative embodiment of the present invention, the invention is not intended to be so limited. Other embodiments and modifications to the preferred embodiment that utilize the teachings herein set forth are intended to be within the scope and spirit of the invention.

What is claimed is:

1. A bracket for attachment to a railing spindle, the bracket comprising:

an elongate socket body composed of elastomeric material and having sidewalls defining an internal socket body chamber dimensioned for close receipt of the railing spindle therein;

a rearward side of the socket body having opposed rearward sidewall portions defining an elongate access channel therebetween in communication with the socket body chamber and sized smaller in a quiescent width than a width dimension of the railing spindle;

the socket body sidewalls flexing laterally under the influence of outwardly directed applied biasing force to widen the access channel and allow admittance of the railing spindle into the socket body chamber and, upon release of the applied biasing force, resiliently returning to an original position to narrow the access channel to the quiescent width;

the rearward sidewall portions having grip surface means responsive to application of the applied biasing force and the grip surface means comprises an outwardly directed elongate flange extending along an inner edge of each rearward sidewall portion.

2. A bracket for attachment to a railing spindle, the bracket comprising:

an elongate socket body composed of elastomeric material and having sidewalls defining an internal socket body chamber dimensioned for close receipt of the railing spindle therein;

a rearward side of the socket body having opposed rearward sidewall portions defining an elongate access channel therebetween in communication with the socket body chamber and sized smaller in a quiescent width than a width dimension of the railing spindle;

the socket body sidewalls flexing laterally under the influence of outwardly directed applied biasing force to widen the access channel and allow admittance of the railing spindle into the socket body chamber and, upon release of the applied biasing force, resiliently returning to an original position to narrow the access channel to the quiescent width;

the rearward sidewall portions having grip surface means responsive to application of the applied biasing force and wherein the access channel has an upper portion of substantially constant width dimension extending downward along an upper portion of the rearward side of the socket body and a wider lower access channel portion disposed below the upper access channel portion.

3. A bracket for attachment to a railing spindle, the bracket comprising:

an elongate socket body composed of elastomeric material and having sidewalls defining an internal socket body chamber dimensioned for close receipt of the railing spindle therein;

a rearward side of the socket body having opposed rearward sidewall portions defining an elongate access channel therebetween in communication with the socket body chamber and sized smaller in a quiescent width than a width dimension of the railing spindle;

the socket body sidewalls flexing laterally under the influence of outwardly directed applied biasing force to widen the access channel and allow admittance of the railing spindle into the socket body chamber and, upon release of the applied biasing force, resiliently returning to an original position to narrow the access channel to the quiescent width;

the rearward sidewall portions having grip surface means responsive to application of the applied biasing force and wherein each rearward sidewall portion respectively extends partially down the rearward side of the socket body.

4. A bracket according to claim 3, wherein access to the rearward side of the socket body chamber is open below lower terminal ends of the rearward sidewall portions.

5. A bracket according to claim 4, wherein the rearward sidewall portions extend downward from an upper end of the socket body.

6. A bracket according to claim 4, wherein the lower terminal ends of the rearward sidewall portions taper outwardly to respective lateral sidewalls of the socket body.

7. A bracket for attachment to a railing spindle, the bracket comprising:

an elongate socket body composed of elastomeric material and having a forward sidewall and lateral sidewalls defining an internal socket body chamber dimensioned for close receipt of the railing spindle therein, the lateral sidewalls being formed unitarily with the forward sidewall and connecting to opposite edges of the forward sidewall;

a rearward side of the socket body having opposed rearward sidewall portions partially enclosing an upper portion of the chamber, the rearward sidewall portions defining an elongate access channel therebetween communicating with the upper portion of the socket body chamber and nominally sized in a quiescent state to be smaller in width than a width dimension of the railing spindle; and the socket body lateral sidewalls flexing laterally about a respective said edge of the forward under the influence of outwardly directed applied biasing force to widen sidewall the access channel and, upon release of the applied force, resiliently returning the access channel to its quiescent state width;

wherein the access channel substantially extends between the lateral sidewalls of the socket body at a lower portion of the chamber and wherein the access channel has a substantially constant width dimension at the upper portion of the chamber and widens outwardly in width dimension at the lower portion of the chamber.

8. A bracket for attachment to a railing spindle, the bracket comprising:

an elongate socket body composed of elastomeric material and having a forward sidewall and lateral sidewalls defining an internal socket body chamber dimensioned for close receipt of the railing spindle therein, the lateral sidewalls being formed unitarily with the forward sidewall and connecting to opposite edges of the forward sidewall;

a rearward side of the socket body having opposed rearward sidewall portions partially enclosing an upper portion of the chamber, the rearward sidewall portions defining an elongate access channel therebetween communicating with the upper portion of the socket body chamber and nominally sized in a quiescent state to be smaller in width than a width dimension of the railing spindle; and the socket body lateral sidewalls flexing laterally about a respective said edge of the forward under the influence of outwardly directed applied biasing force to widen sidewall the access channel and, upon release of the applied force, resiliently returning the access channel to its quiescent state width;

wherein the rearward sidewall portions extend downward to lower terminal ends that taper outwardly to respective lateral sidewalls of the socket body.

9. A bracket for attachment to a railing spindle, the bracket comprising:

an elongate socket body composed of elastomeric material and having a forward sidewall and lateral sidewalls defining an internal socket body chamber dimensioned for close receipt of the railing spindle therein, the lateral sidewalls being formed unitarily with the forward sidewall and connecting to opposite edges of the forward sidewall;

a rearward side of the socket body having opposed rearward sidewall portions partially enclosing an upper portion of the chamber, the rearward sidewall portions defining an elongate access channel therebetween communicating with the upper portion of the socket body chamber and nominally sized in a quiescent state to be smaller in width than a width dimension of the railing spindle; and the socket body lateral sidewalls flexing laterally about a respective said edge of the forward under the influence of outwardly directed applied biasing force to widen sidewall the access channel and, upon release of the applied force, resiliently returning the access channel to its quiescent state width;

wherein the rearward sidewall portions have grip surface means responsive to application of the applied biasing force and wherein the grip surface means comprises an outwardly directed elongate flange extending along an inner edge of each rearward sidewall portion.

10. A bracket for attachment to a railing spindle, the bracket comprising:

an elongate socket body composed of elastomeric material and having a forward sidewall and lateral sidewalls defining an internal socket body chamber dimensioned for close receipt of the railing spindle therein, the lateral sidewalls being formed unitarily with the forward sidewall and connecting to opposite edges of the forward sidewall;

a rearward side of the socket body having opposed rearward sidewall portions partially enclosing an upper portion of the chamber, the rearward sidewall portions defining an elongate access channel therebetween communicating with the upper portion of the socket body chamber and nominally sized in a quiescent state to be smaller in width than a width dimension of the railing spindle; and the socket body lateral sidewalls flexing laterally about a respective said edge of the forward under the influence of outwardly directed applied biasing force to widen sidewall the access channel and, upon release of the applied force, resiliently returning the access channel to its quiescent state width;

further comprising article support means connected to the forward sidewall of the socket body and extending outward therefrom and wherein the socket body article support means comprises a suspension hook.

11. A method of mounting a bracket to a railing spindle, the bracket having an elongate socket body composed of elastomeric material and comprising a forward sidewall, lateral sidewalls, and first and second rearward sidewall portions defining an internal socket body chamber, and the rearward sidewall portions defining an access channel therebetween extending downward along an upper portion of the socket body chamber to a rearwardly open lower portion of the socket body chamber, comprising the steps of:

positioning the socket body at an acute angle adjacent the railing spindle with a lower end of the socket body closest to the railing spindle;

registering the railing spindle into the open lower portion of the socket body chamber;

rotating an upper end of the socket body about the lower end of the forward socket sidewall and toward the railing spindle;

applying a directional force to the rearward sidewall portions to bias the sidewall portions from a quiescent position outward and widen the access channel therebetween;

passing the railing spindle through the widened access channel and into the socket body chamber; and removing the biasing force from the lateral sidewalls and the rearward sidewall portions to allow the rearward sidewall portions to resume the quiescent position and narrow the access channel.

12. A method of mounting a bracket to a railing spindle as set forth in claim 11, further comprising the step of digitally engaging and applying the directional biasing force to flange portions of the rearward sidewall portions.

* * * * *